US005410759A

United States Patent [19]

Hari

[11] Patent Number: 5,410,759

[45] Date of Patent: May 2, 1995

[54] TOP GARMENT PATTERNED WITH SLEEVES ABOVE THE HEAD

[76] Inventor: Todd N. Hari, 8535 Central Ave. NE., Ste. 101, Blaine, Minn. 55434

[21] Appl. No.: 278,064

[22] Filed: Jul. 20, 1994

Related U.S. Application Data

[63] Continuation of Ser. No. 21,513, Feb. 23, 1993, abandoned.

[51] Int. Cl.[6] ..... A41D 27/10

[52] U.S. Cl. ..... 2/108; 2/93; 2/125

[58] Field of Search ..... 2/115, 125, 93, 95, 2/106, 90, 108, 243.1, 69

[56] References Cited

U.S. PATENT DOCUMENTS

| | | | |
|---|---|---|---|
| 422,669 | 3/1890 | Upthegrove . | |
| 483,686 | 10/1892 | Goodman . | |
| 1,177,952 | 4/1916 | Inman . | |
| 1,965,995 | 7/1934 | Tripp | 2/125 |
| 2,280,479 | 4/1942 | Cohen | 2/74 |
| 2,291,025 | 7/1942 | Casella | 2/93 |
| 2,309,037 | 1/1943 | Berman | 2/93 |
| 2,364,066 | 12/1944 | Giuseffi | 2/93 |
| 2,369,416 | 2/1945 | Solomon | 2/125 |
| 2,390,188 | 12/1945 | Sholder | 2/125 |
| 2,438,171 | 3/1948 | Jamieson | 2/125 |
| 2,458,004 | 1/1949 | Kerr | 2/93 |
| 2,554,380 | 5/1951 | Olrich et al. | 2/90 |
| 2,583,089 | 1/1952 | Clyne | 2/125 |
| 2,650,364 | 9/1953 | Clyne | 2/93 |
| 2,848,719 | 8/1958 | Clyne | 2/125 |
| 2,943,330 | 7/1960 | Clyne | 2/125 |
| 3,037,210 | 6/1962 | Neuman | 2/125 |
| 3,141,175 | 7/1964 | Heater et al. | 2/125 |
| 3,369,300 | 2/1968 | Green | 2/125 |
| 3,614,789 | 10/1971 | Menut | 2/93 |
| 3,654,632 | 4/1972 | Lacroix | 2/125 |
| 3,719,956 | 3/1973 | Glassberg | 2/125 |
| 4,473,908 | 10/1984 | Knecht | 2/115 |
| 4,864,655 | 9/1989 | McKenney et al. | 2/93 |
| 5,010,591 | 4/1991 | Kalaam | 2/93 |
| 5,165,110 | 11/1992 | Grilliot et al. | 2/125 |

FOREIGN PATENT DOCUMENTS

| | | | |
|---|---|---|---|
| 153466 | 9/1953 | Australia | 2/125 |

*Primary Examiner*—Clifford D. Crowder
*Assistant Examiner*—Amy B. Vanatta
*Attorney, Agent, or Firm*—Kinney & Lange

[57] ABSTRACT

Top garments which permit the wearer's arms to move freely without ride-up have sleeves patterned to lay flat above the head. Positioning of the sleeves at such an orientation during patterning is advantageous because it allows the wearer to raise each arm above the head without distorting the shape of the garment by inducing ride-up of the waistband, bunching of material around the shoulder area or pulling of the cuff. Such a garment is especially useful for physical activities which require extensive arm movements.

19 Claims, 9 Drawing Sheets

TOP GARMENT PATTERNED WITH SLEEVES ABOVE THE HEAD

This is a continuation of application Ser. No. 08/021,513, filed Feb. 23, 1993, now abandoned.

BACKGROUND OF THE INVENTION

The present invention relates to the construction of sleeve-type garments for the human body. More particularly, the invention relates to sleeve-type garments which can be used as shirts, blouses, sweaters, jackets, dresses and similar articles of clothing which have a body portion covering at least an upper portion of the torso and sleeve portions each covering at least an upper portion of the arms of the wearer. This invention allows for free range of movement of the arms including raising the arms above the wearer's head such that there is no raising up of the waistband, bunching of material around the shoulder area or pulling of the cuff.

Traditional top garments are designed in a manner which restricts free movement of the arms. Particularly, movement of either arm above the wearer's head produces a raising up of the waistband which exposes a portion of the wearer's torso. Such raising up of the waistband, otherwise known as "ride-up", can be potentially dangerous in certain situations. For example, in a construction, industrial or military setting, such ride-up can expose the body to a hostile environment. Another disadvantage of traditional top garments is bunching of material that occurs between the neck and shoulder when an arm is raised upward above a horizontal plane which extends from each shoulder of the body. As a result of excess material bunching around the shoulder area, less material is available to cover the full arm length. Thus, pulling of the cuff toward the shoulder is another problem associated with prior art top garment designs. Ride-up, bunching and pulling of the cuff occur because traditional top garments are designed with each sleeve extended downward. Some prior art top garments are designed with each sleeve extended outwardly, 180 degrees from each other, in opposite directions from the body. However, with all prior art top garments, any upward movement of the arms above the horizontal plane which extends outwardly from each shoulder, causes distortion of the top garment in the form of ride-up, bunching of material around the shoulder and pulling of the cuff. Traditional top garments are restrictive because arm movements which extend the sleeves above shoulder level reduce comfort and distort the shape of the garment.

Prior art top garments have sought to alleviate the problem of ride-up, bunching of material near the shoulders and pulling of the cuff by inserting gussets or extra pieces of material between each sleeve and the body of the garment. These extra pieces of material are not only unsightly, they do not eliminate the problems of ride-up, bunching of material around the shoulder or pulling of the cuff when the arm is raised above the head.

Other prior art references disclose patterning top garments so that excess material is allotted in the shoulder area as well as across the chest to allow freedom of lateral or forward movement of the wearer's arms. However, no prior art reference shows a top garment which patterns each sleeve to dimensions such that when the garment is laid in a flat configuration, the sleeves can extend above the head with no distortion of the shape of the garment. The inadequacies of the prior art are overcome by the present invention which eliminates ride-up, bunching of material around the shoulder and pulling of the cuff.

SUMMARY OF THE INVENTION

In the present invention, sleeves of a top garment are patterned as if the arms were positioned above the wearer's head, in order to provide a garment with unrestricted movement. A top garment made according to this invention can accommodate arm positions that can range from fully down at the sides to directly above the head without any ride-up of the waistband, bunching of material around the shoulders or pulling of the cuff. The top garment can be cut from either a one piece or multipiece pattern.

In one preferred embodiment of the present invention, each sleeve is patterned so that a base length of the sleeve is greater than a top length of the sleeve. Also in the preferred embodiment, each sleeve extends from the body portion of the garment so that when laid in a flat configuration, an angle at the intersection of a first horizontal plane of the garment and the base length of the sleeve is greater than an angle at the intersection of a second horizontal plane of the garment and the top length of the sleeve.

In addition to everyday clothing, this invention is particularly suited for top garments used as sportswear, uniforms and occupational clothing. Appropriate use of garments made in accordance with the present invention includes activities like camping, mountain climbing, active sports, industrial, military and intensive labor use. Also, top garments employing the invention are ideal for the physically challenged and injured.

DETAILED DESCRIPTION OF THE PREFERRED EMBODIMENTS

Figure 1:
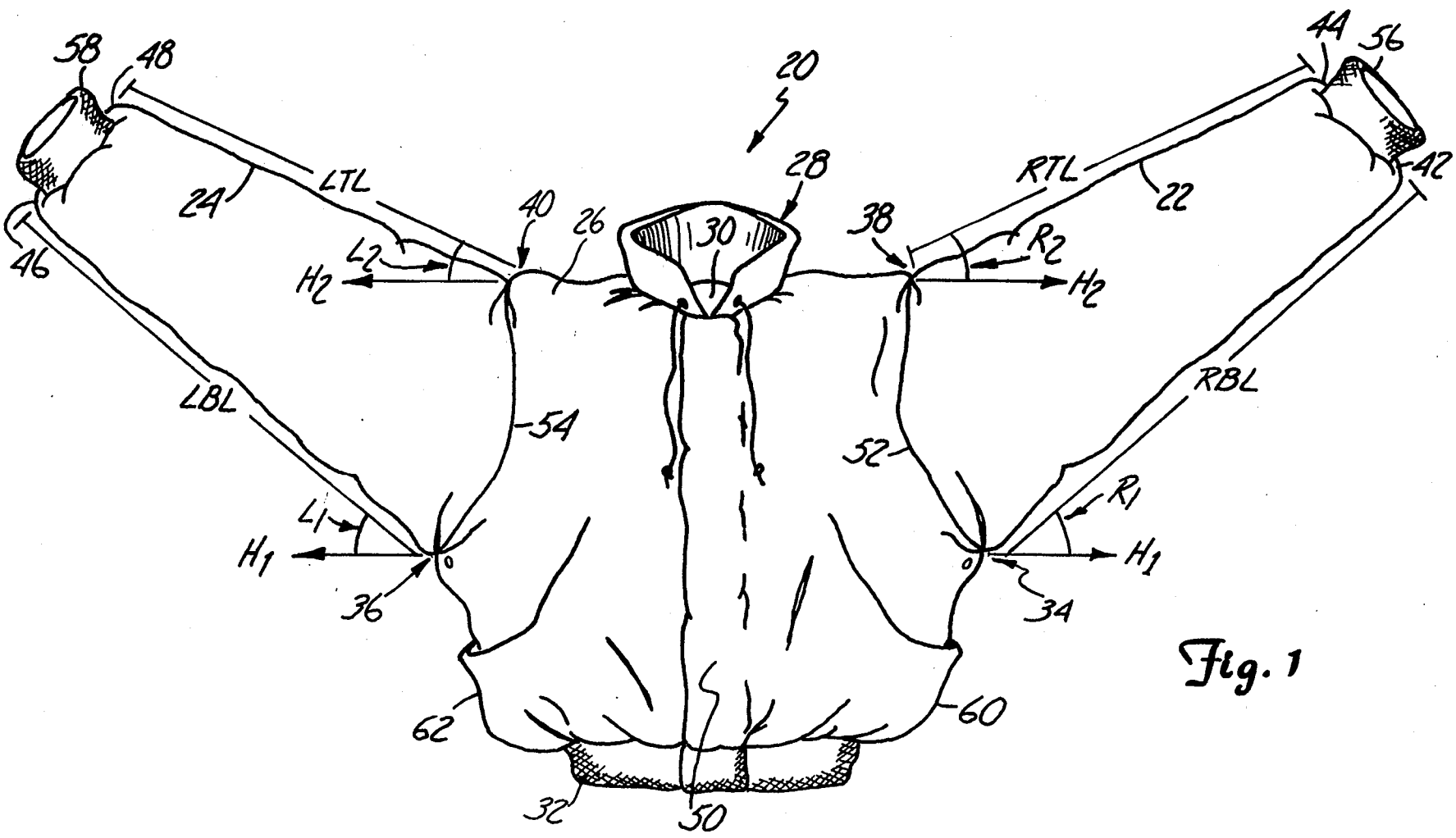
FIG. 1 is a front view of a jacket with set in sleeves made in accordance with the present invention.
Figure 2:
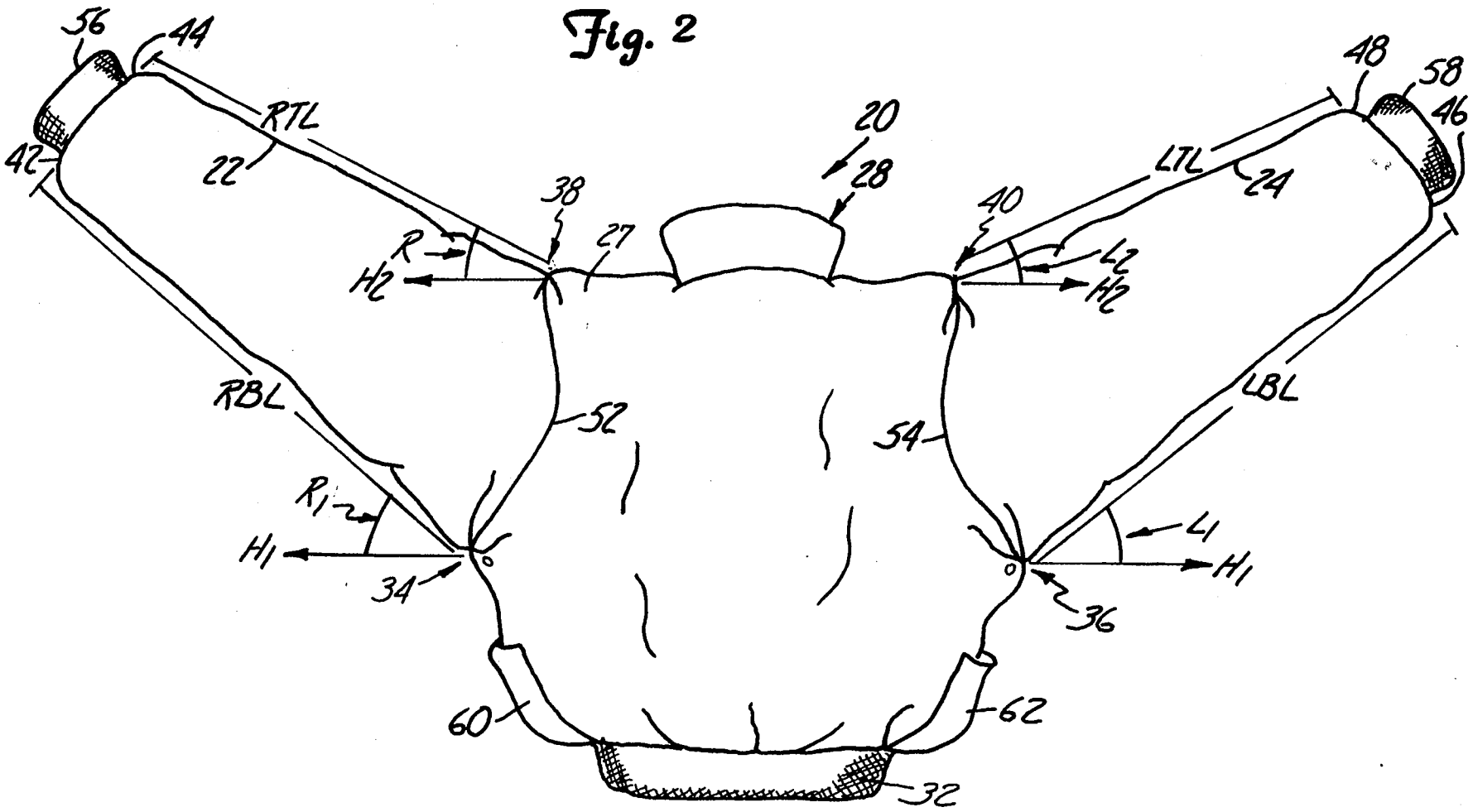
FIG. 2 is a back view of the jacket shown in FIG. 1.

FIGS. 1 and 2 show a front view and a back view, respectively, of jacket with set in sleeves 20 laid in a flat configuration. Jacket 20 is made in accordance with the present invention. Jacket 20 comprises right sleeve 22, left sleeve 24, front panel 26, back panel 27, collar 28, neck opening 30, waistband 32, front closure 50, right continuous seam 52, left continuous seam 54, right cuff 56, left cuff 58, right pocket 60 and left pocket 62. Also illustrated in FIGS. 1 and 2 are right base point 34, left base point 36, right top point 38, left top point 40, right bottom sleeve end 42, right top sleeve end 44, left bottom sleeve end 46, left top sleeve end 48, horizontal plane H1, horizontal plane H2, right base length RBL, left base length LBL, right top length RTL, left top length LTL, right base angle R1, right top angle R2, left base angle L1 and left top angle L2.

Jacket 20 is assembled from a multi-piece pattern in which right sleeve 22 and left sleeve 24 are joined to front panel 26 and back panel 27 via continuous seams 52 and 54, respectively. Once assembled, right sleeve 22 has two distinct contact points with front panel 26 and back panel 27. These points are right base point 34 and right top point 38. Correspondingly, assembled left sleeve 24 has similar contact points with front panel 26 and back panel 27, namely, left base point 36 and left top point 40.

The distance between right base point 34 and right bottom sleeve end 42 is defined as right base length RBL. The distance between right top point 38 and right top sleeve end 44 is defined as right top length RTL. Left sleeve 24 has left base length LBL defined as the distance between left base point 36 and left bottom sleeve end 46. Left top length LTL is the distance between left top point 40 and left top sleeve end 48.

Horizontal plane H1 intersects jacket 20 perpendicularly at right base point 34 and left base point 36. Right base angle R1 is formed at the intersection of horizontal plane H1 and right base length RBL. Horizontal plane H2 intersects jacket 20 perpendicularly at right top point 38 and left top point 40. Right top angle R2 is formed at the intersection of horizontal plane H2 and right top length RTL. Similarly, left base angle L1 is formed at the intersection of horizontal plane Hi and left base length LBL. Left top angle L2 is formed at the intersection of horizontal plane H2 and left top length LTL.

In accordance with the invention, right base length RBL and left base length LBL are greater than their respective top lengths, right top length RTL and left top length LTL. Also, right base angle R1 and left base angle L1 are greater than right top angle R2 and left top angle L2, respectively. By patterning jacket 20 to the specifications of the present invention, right sleeve 22 and left sleeve 24 extend upwardly and outward from the body portion when laid in a flat configuration. Sleeves 22 and 24 are patterned at angles so that when the arms are raised above the head, there is no distortion of the garment. Thus, the wearer's arms can be moved freely without any pull on the garment fabric to cause ride-up or bunching.

Various style features are also included with jacket 20. For example, collar 28 is joined around a circumference of neck opening 30. Waistband 32 is joined to front panel 26 and extends around to join back panel 27. Right cuff 56 and left cuff 58 are joined to an end of right sleeve 22 and an end of left sleeve 24, respectively. Front closure 50 is attached to front panel 26. Finally, right pocket 60 and left pocket 62 are joined to front panel 26 and back panel 27 as added features.

Figure 3:
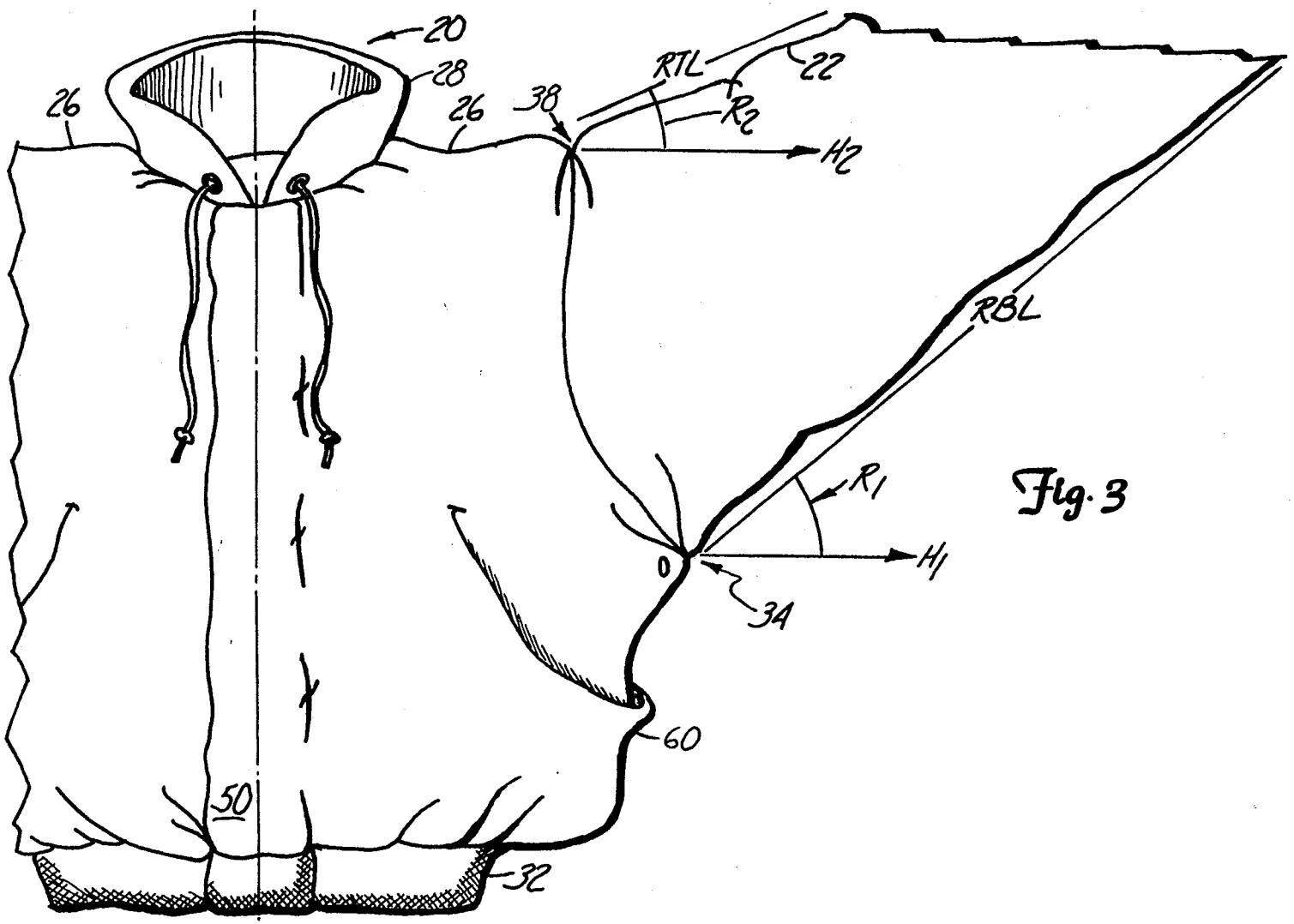
FIG. 3 is a close-up front view of a right sleeve of the jacket shown in FIGS. 1 and 2.

FIG. 3 is a close-up front view of right sleeve 22 of jacket 20 shown in FIGS. 1 and 2. This view is provided to clearly show the relationship between base angles and top angles. In this case, right base angle R1, which is formed at the intersection of horizontal plane H1 and right base length RBL, is greater than right top angle R2, which is formed at the intersection of horizontal plane H2 and right top length RTL. Front panel 26 with style features collar 28, waistband 32, front closure 50 and right pocket 60 is also shown. Of course, a corresponding close-up front view of left sleeve 24 would show the same relationship between left base angle L1 and left top angle L2.

Figure 4:
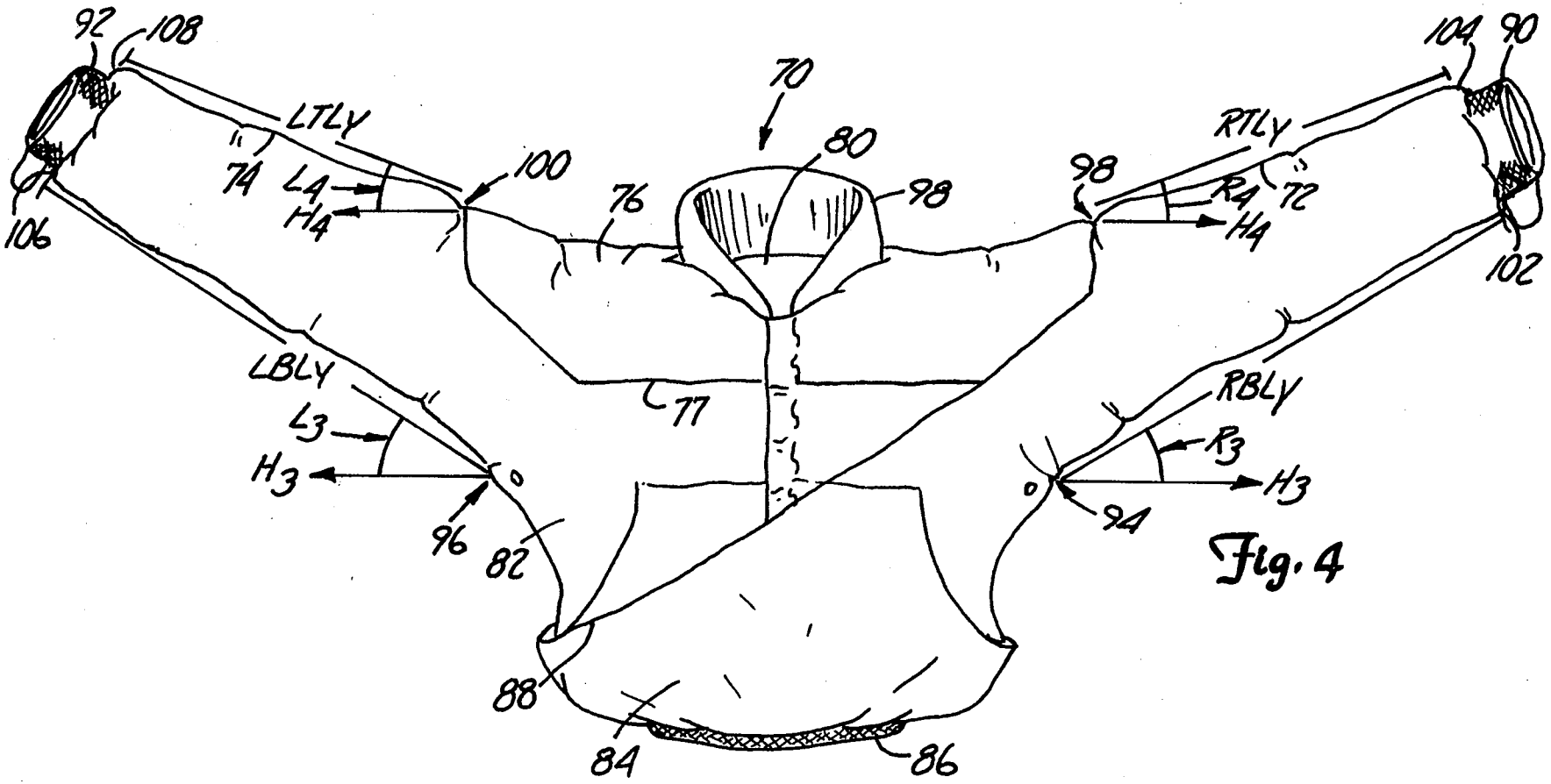
FIG. 4 is a front view of a jacket with yoke made in accordance with the present invention.
Figure 5:
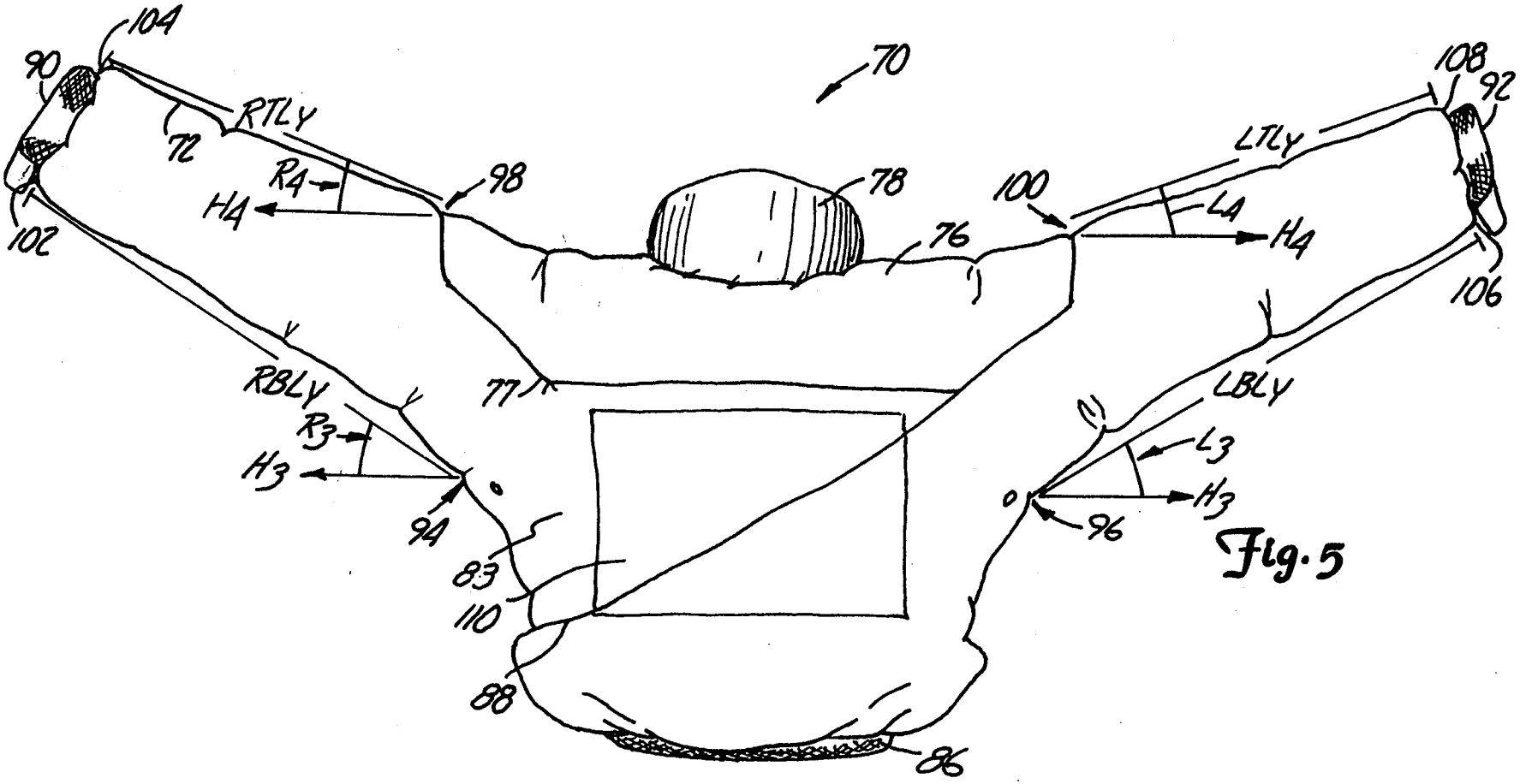
FIG. 5 is a back view of the jacket shown in FIG. 4.

FIGS. 4 and 5 show a front view and a back view, respectively, of jacket with yoke 70 laid in a flat configuration. Jacket 70 is made, in accordance with the present invention, from a one-piece pattern in which both sleeves and body portion of the jacket are cut from a continuous piece of fabric. Jacket 70 comprises right sleeve 72, left sleeve 74, yoke 76, continuous seam 77, collar 78, neck opening 80, front panel 82, back panel 83, front pocket 84, waistband 86, style feature 88, right cuff 90 and left cuff 92. Also shown in FIGS. 4 and 5 are right base point 94, left base point 96, right top point 98, left top point 100, right bottom sleeve end 102, right top sleeve end 104, left bottom sleeve end 106, left top sleeve end 108, style element 110, horizontal plane H3, horizontal plane H4, right base length RBLy, left base length LBLy, right top length RTLy, left top length LTLy, right base angle R3, left base angle L3, right top angle R4 and left top angle L4.

Jacket 70 is made from a one-piece pattern in which right sleeve 72 and left sleeve 74 are cut from a continuous piece of fabric as extensions of front panel 82 and back panel 83. Yoke 76 is joined to front panel 82 and back panel 83 via continuous seam 77.

Horizontal plane H3 intersects jacket 70 perpendicularly at right base point 94 and left base point 96. Horizontal plane H4 intersects jacket 70 perpendicularly at right top point 98 and left top point 100. Right base length RBLy extends from right base point 94 to right bottom sleeve end 102. Right top length RTLy extends from right top point 98 to right top sleeve end 104. Similarly, left base length LBLy extends from left base point 96 to left bottom sleeve end 106. Left top length LTLy extends from left top point 100 to left top sleeve end 108.

Right base angle R3 is formed at the intersection of horizontal plane H3 and right base length RBLy. Right top angle R4 is formed at the intersection of horizontal plane H4 and right top length RTLy. Correspondingly, left base angle L3 is formed at the intersection of horizontal plane H3 and left base length LBLy. Left top angle L4 is formed at the intersection of horizontal plane H4 and left top length LTLy.

In accordance with the present invention, right base length RTLy and left base length LTLy are each greater than their respective top lengths, right top length RTLy and left top length LTLy. Thus, right base angle R3 is greater than right top angle R4. For left sleeve 74, left base angle L3 is greater than left top angle L4. As explained above, with reference to jacket 20 of FIGS. 1 and 2, sleeves 72 and 74 are patterned to extend upwardly above the head to allow unrestricted movement of the wearer's arms.

Additional style features are also shown on jacket 70. Collar 78 is joined around a circumference of neck opening 80, which is cut out of yoke 76. Waistband 86 is joined to an end of front panel 82 and extends around to join back panel 83 as well. Front pocket 84 is joined to front panel 82. Style feature 88 extends diagonally across front panel 82 and back panel 83. Right cuff 90 is joined to an end of right sleeve 72. Left cuff 92 is joined to an end of left sleeve 74. Finally, style element 110 is attached to back panel 83.

Figure 6:
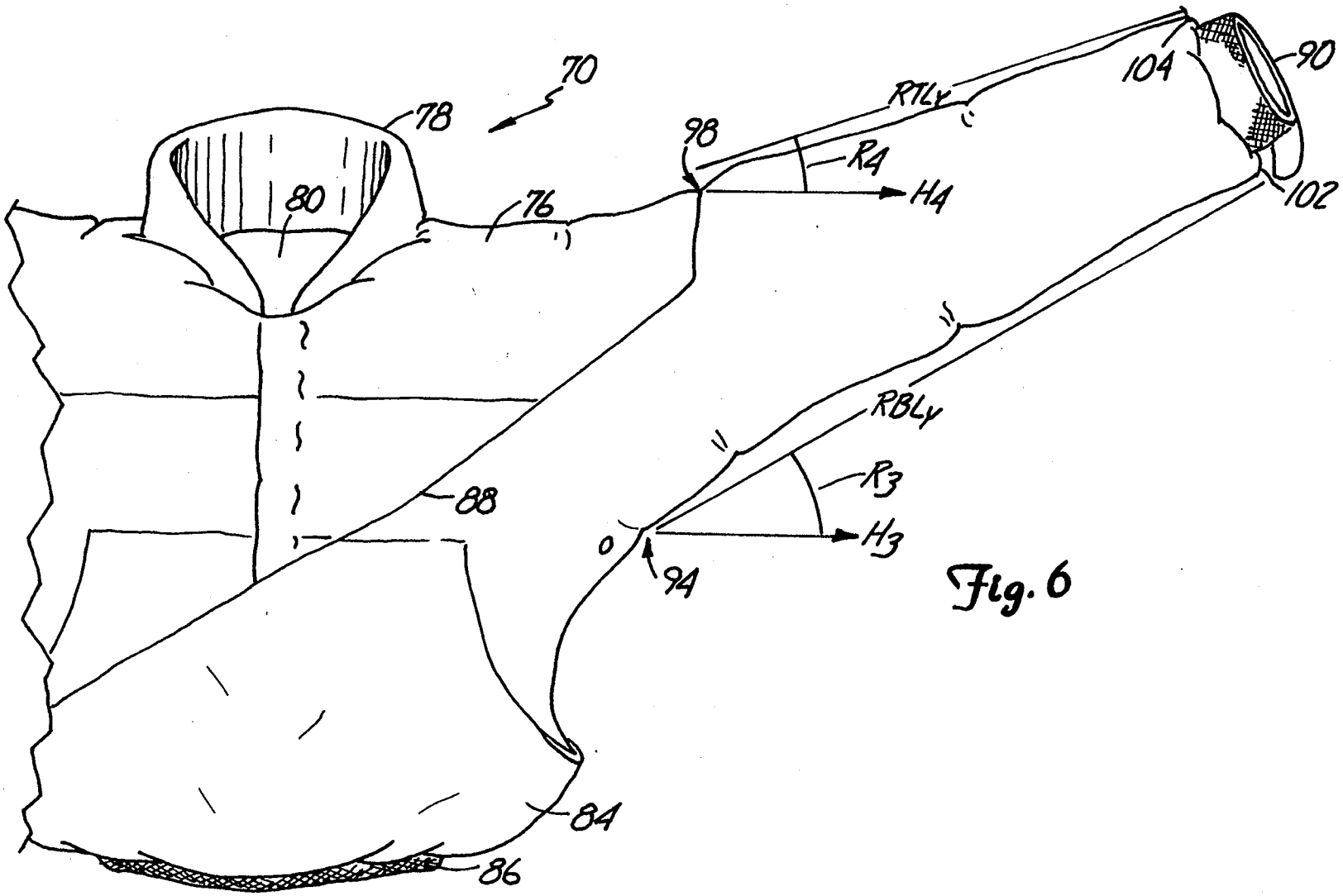
FIG. 6 is a close-up front view of a right sleeve of the jacket shown in FIGS. 4 and 5.

FIG. 6 is a close-up front view of right sleeve 72 of jacket 70 shown in FIGS. 4 and 5. This view is provided to show clearly that right base angle R3, which is formed at the intersection of horizontal plane H3 and right base length RBLy, is greater than right top angle R4, which is formed at the intersection of horizontal plane H4 and right top length RTLy. In comparison to the set in sleeve jacket design of FIGS. 1–3, the addition of yoke 76 moves right top point 98 and left top point 100 (not shown) further toward right top sleeve end 104 and left top sleeve end 108 (not shown), respectively. The placement of right and left top points at the end of yoke 76, however, does not alter the effects of the invention. Also shown is front panel 82 with attached style features front pocket 84 and waistband 86. Collar 78 surrounds neck opening 80 and is shown attached to yoke 76. Right cuff 90 surrounds an end of sleeve 72. A close-up front view of left sleeve 74 would show the same relationship between left base angle L3 and left top angle L4.

Figure 7:
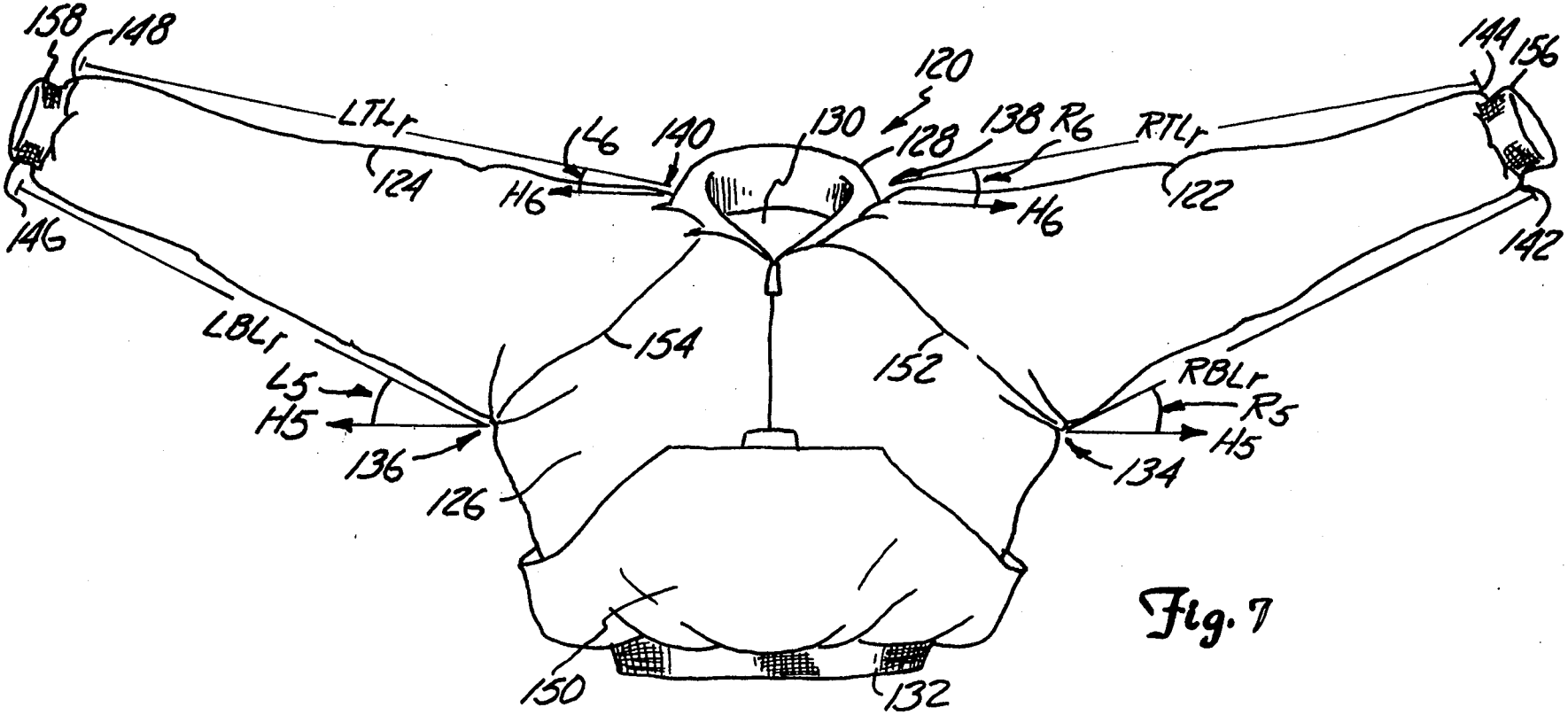
FIG. 7 is a front view of a jacket with raglan sleeves made in accordance with the present invention.
Figure 8:
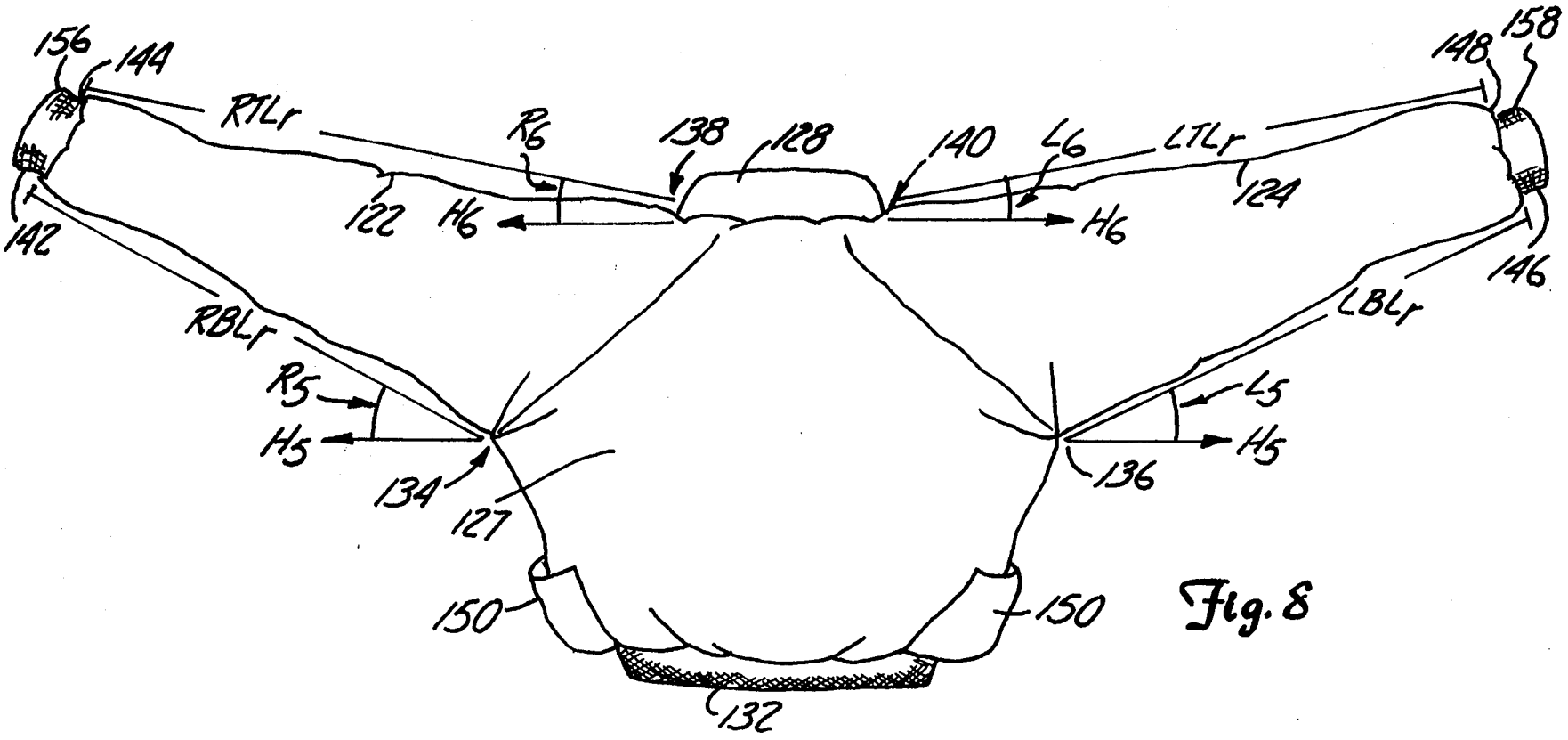
FIG. 8 is a back view of the jacket shown in FIG. 7.

FIGS. 7 and 8 show a front view and a back view, respectively, of jacket with raglan sleeves 120 laid in a flat configuration. Jacket 120 is made in accordance with the present invention. Jacket 120 comprises right sleeve 122, left sleeve 124, front panel 126, back panel 127, collar 128, neck opening 130, waistband 132, front pocket 150, right continuous seam 152, left continuous seem 154, right cuff 156 and left cuff 158. Also illustrated are right base point 134, left base point 136, right top point 138, left top point 140, right bottom sleeve end 142, right top sleeve end 144, left bottom sleeve end 146, left top sleeve end 148, horizontal plane H5, horizontal plane H6, right base length RBLr, right top length RTLr, left base length LBLr, left top length LTLr, right base angle R5, right top angle R6, left base angle L5 and left top angle L6.

Jacket 120 is assembled from a multi-piece pattern in which right sleeve 122 and left sleeve 124 are joined to front panel 126 and back panel 127 via continuous seems 152 and 154, respectively. Once assembled, right sleeve 122 has two distinct contact points with front panel 126 and back panel 127. These points are right base point 134 and right top point 138. Correspondingly, assembled left sleeve 124 has similar contact points with front panel 126 and back panel 127, which are left base point 136 and left top point 140.

The distance between right base point 134 and right bottom sleeve end 142 is right base length RBLr. The distance between right top point 138 and right top sleeve end 144 is right top length RTLr. Similarly, left sleeve 124 has left base length LBLr defined as the distance between left base point 136 and left bottom sleeve end 146. Left top length LTLr is the distance between left top point 140 and left top sleeve end 148.

Horizontal plane H5 intersects jacket 120 perpendicularly at right base point 134 and left base point 136. Right base angle R5 is formed at the intersection of horizontal plane H5 and right base length RBLr. Horizontal plane H6 intersects jacket 120 perpendicularly at right top point 138 and left top point 140. Right top angle R6 is formed at the intersection of horizontal plane H6 and right top length RTLr. Correspondingly, left base angle L5 is formed at the intersection of horizontal plane H5 and left base length LBLr. Left top angle L6 is formed at the intersection of horizontal plane H6 and left top length LTLr.

In accordance with the present invention, right base length RBLr and left base length LBLr are each greater than their respective top lengths, right top length RTLr and left top length LTLr. Also, right base angle R5 and left base angle L5 are greater than right top angle R6 and left top angle L6, respectively. Thus, in accordance with the invention, right sleeve 122 and left sleeve 124 extend upwardly and outward from the body portion when laid in a flat configuration.

Style features shown on jacket 120 include front pocket 150, which is joined to front panel 126 and back panel 127, waistband 132, which is joined to front panel 126 and extends around to join back panel 127 and collar 128, which is joined to the circumference of neck opening 130. Right cuff 156 is joined to an end of right sleeve 122. Left cuff 158 is joined to an end of left sleeve 124.

Figure 9:
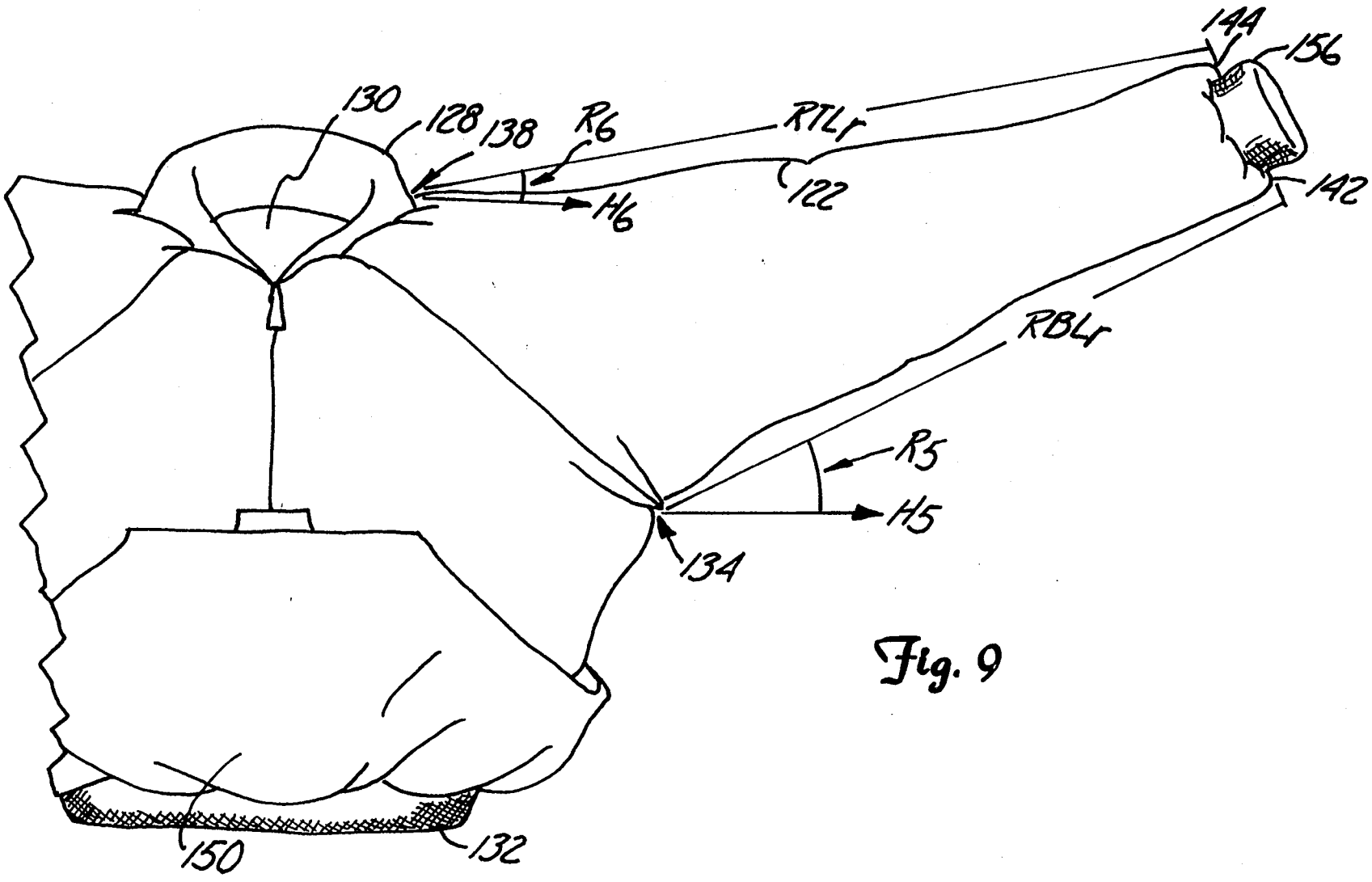
FIG. 9 is a close-up front view of a right sleeve of the jacket shown in FIGS. 7 and 8.

FIG. 9 is a close-up front view of right sleeve 122 of jacket 120 shown in FIGS. 7 and 8. This view is provided to show that right base angle R5, which is formed at the intersection of horizontal plane H5 and right base length RBLr is greater than right top angle R6, which is formed at the intersection of horizontal plane H6 and right top length RTLr. Also shown are style features collar 128, waistband 132 and front pocket 150, all of which are positioned on front panel 126. Right cuff 156 is joined to an end of sleeve 122. A corresponding close-up front view of left sleeve 124 would show the same relationship between left base angle L5 and left top angle L6. Compared to the jackets of FIGS. 1–6, jacket 120 has right top point 138 and left top point 140 positioned closer to neck opening 130. This location of right and left top points, however, does not affect the superior freedom of movement obtained with the present invention.

The claimed invention achieves a top garment design which allows total freedom of arm movement. Unrestricted movement is accomplished by patterning each sleeve so that its base length is greater than its top length. Also, each sleeve extends from the body of the garment such that an angle formed at a horizontal plane which intersects the garment at the base of the sleeve is greater than an angle formed at a horizontal plane which intersects the garment at the top of the sleeve.

A top garment made in accordance with the present invention has sleeves which extend upwardly and outward from the body when the garment is laid against a flat surface. The sleeves are designed so that the natural position of each arm is above the wearer's head. Each sleeve of the garment allows for movement of the arm without distortion of the fabric or shape of the garment. Thus, a top garment made in accordance with the present invention achieves advantages over traditional top garments in that distortion of the garment, especially distortion in the form of ride-up bunching of material around the shoulder and pulling of the cuff, is eliminated.

Although the present invention has been described with reference to preferred embodiments, workers skilled in the art will recognize that changes may be made in the form of body and/or sleeve configurations without departing from the spirit and scope of the invention.

What is claimed is:

1. A top garment comprising:

a body section which includes a front panel, a back panel and which has a neck opening at an upper end;

a right sleeve attached to the body section by first and second right continuous seams each extending between a right top point of attachment of the right sleeve to the front and back panels and a right base point of attachment to the front and back panels, the first right seam attaching the right sleeve to the front panel and the second right seam attaching the right sleeve to the back panel, at least one of the first and second right seams being semi-circular between the right top point of attachment and the right base point of attachment, the right sleeve having a right top length between the right top point of attachment of the right sleeve to the body section and a right top sleeve end, and a right base length between the right base point of attachment of the right sleeve to the body section and a right bottom sleeve end, wherein the right base length is greater than the right top length; and a left sleeve attached to the body section by first and second left continuous seams each extending between a left top point of attachment of the left sleeve to the front and back panels and a left base point of attachment to the front and back panels, the first left seam attaching the left sleeve to the front panel and the second left seam attaching the left sleeve to the back panel, at least one of the first and second left seams being semi-circular between the left top point of attachment and the left base point of attachment, the left sleeve having a left top length between the left top point of attachment of the left sleeve to the body section and a left top sleeve end, and a left base length between the left base point of attachment of the left sleeve to the body section and a left bottom sleeve end, wherein the left base length is greater than the left top length.

2. The top garment of claim 1 wherein the right top sleeve end is located directly above a right wrist.

3. The top garment of claim 1 wherein the right bottom sleeve end is located directly below a right wrist.

4. The top garment of claim 1 wherein the left top sleeve end is located directly above a left wrist.

5. The top garment of clam 1 wherein the left bottom sleeve end is located directly below a left wrist.

6. The top garment of claim 1 wherein the left and right sleeves are attached at left and right shoulders of the body section.

7. The top garment of claim 1 wherein the left and right sleeves are attached to each of two single pieces of material which form the body section.

8. A top garment comprising:

a body section having a front panel, a back panel, a neck opening, a right sleeve opening and a left sleeve opening;

a right sleeve attached to the body at the right sleeve opening section by first and second right continuous seams each extending between a right top point of attachment of the right sleeve to the front and back panels and a right base point of attachment to the front and back panels, the first right seam attaching the right sleeve to the front panel and the second right seam attaching the right sleeve to the back panel, at least one of the first and second right seams being semi-circular between the right top point of attachment and the right base point of attachment, the right sleeve oriented with respect to the body section so that when the top garment is laid flat, the right sleeve extends outwardly to the right and above a right shoulder portion of the body section; and a left sleeve attached to the body section at the left sleeve opening by first and second left continuous seams each extending between a left top point of attachment of the left sleeve to the front and back panels and a left base point of attachment to the front and back panels, the first left seam attaching the left sleeve to the front panel and the second left seam attaching the left sleeve to the back panel, at least one of the first and second left seams being semi-circular between the left top point of attachment and the left base point of attachment, the left sleeve oriented with respect to the body section so that when the top garment is laid flat, the left sleeve extends outwardly to the left and above a left shoulder portion of the body section.

9. The top garment of claim 8 wherein a first horizontal plane intersects the top garment perpendicularly at a bottom portion of the right and the left sleeve openings and a second horizontal plane intersects the top garment perpendicularly at a top portion of the right and left sleeve openings.

10. The top garment of claim 9 wherein an angle formed at the intersection of the first horizontal plane and the right and left sleeves is greater than an angle formed at the intersection of the second horizontal plane and the right and left sleeves.

11. The top garment of claim 8 wherein the left and right sleeves are attached at left and right shoulders of the body section.

12. The top garment of claim 8 wherein the left and right sleeves are attached to the neck opening and form left and right shoulders of the top garment.

13. The top garment of claim 8 wherein the left and right sleeves are attached to each of two single pieces of material which form the body section.

14. A top garment having a front panel, a back panel, a neck opening, a right sleeve and a left sleeve wherein the improvement comprises:

first and second right continuous seams extending between a right top point of attachment of the right sleeve to the front and back panels and a right base point of attachment to the front and back panels, the first right seam attaching the right sleeve to the front panel and the second right seam attaching the right sleeve to the back panel, at least one of the first and second right seams being semi-circular between the right top point of attachment and the right base point of attachment, wherein the right sleeve extends outwardly to the right and above a right shoulder portion of the front and back panels when the garment is laid in a fiat configuration; and first and second left continuous seams extending between a left top point of attachment of the left sleeve to the front and back panels and a left base point of attachment to the front and back panels, the first left seam attaching the left sleeve to the front panel and the second left seam attaching the left sleeve to the back panel, at least one of the first and second left seams being semi-circular between the left top point of attachment and the left base point of attachment, wherein the left sleeve extends outwardly to the left and above a left shoulder portion of the front and back panels when the garment is laid in a fiat configuration.

15. The top garment of claim 14 wherein a first horizontal plane intersects the top garment perpendicularly at a bottom portion of the right and left sleeves and a second horizontal plane intersects the top garment perpendicularly at a top portion of the right and left sleeves.

16. The top garment of claim 15 wherein an angle formed at the intersection of the first horizontal plane and the right and left sleeves is greater than an angle formed at the intersection of the second horizontal plane and the right and left sleeves.

17. The top garment of claim 14 wherein the left and right sleeves are attached at the left and right shoulder portions of the front and back panels.

18. The top garment of claim 14 wherein the left and right sleeves are attached to the neck opening in the front and back panels and form the left and right shoulders of the garment.

19. The top garment of claim 14 wherein the left and right sleeves are attached to each of two single pieces of material which form the front and back panels.

* * * * *